US008955495B2

(12) United States Patent
Joos et al.

(10) Patent No.: US 8,955,495 B2
(45) Date of Patent: Feb. 17, 2015

(54) METHOD AND CONTROL UNIT FOR OPERATING A VALVE

(75) Inventors: Klaus Joos, Walheim (DE); Jens Neuberg, Stuttgart (DE); Traugott Degler, Korntal (DE); Helerson Kemmer, Vaihingen (DE); Hans-Peter Lehr, Stuttgart (DE); Holger Rapp, Ditzingen (DE); Haris Hamedovic, Moeglingen (DE); Bernd Wichert, Kernen (DE); Anh-Tuan Hoang, El Paso, TX (US); Ruben Schlueter, Stuttgart (DE); Joerg Koenig, Stuttgart (DE); Achim Hirchenhein, Trierweiler (DE)

(73) Assignee: Robert Bosch GmbH, Stuttgart (DE)

( * ) Notice: Subject to any disclaimer, the term of this patent is extended or adjusted under 35 U.S.C. 154(b) by 323 days.

(21) Appl. No.: 13/509,948

(22) PCT Filed: Dec. 2, 2010

(86) PCT No.: PCT/EP2010/068715

§ 371 (c)(1),
(2), (4) Date: Aug. 3, 2012

(87) PCT Pub. No.: WO2011/082902

PCT Pub. Date: Jul. 14, 2011

(65) Prior Publication Data

US 2012/0291757 A1 Nov. 22, 2012

(30) Foreign Application Priority Data

Dec. 14, 2009 (DE) ..... 10 2009 054 589

(51) Int. Cl.
*F02M 51/00* (2006.01)
*F02D 41/20* (2006.01)

(Continued)

(52) U.S. Cl.
CPC ..... *F02D 41/20* (2013.01); *F02D 41/2432* (2013.01); *F02D 41/247* (2013.01);

(Continued)

(58) Field of Classification Search
USPC ..... 123/490, 499, 480, 472, 478; 701/101, 701/103, 104; 324/207.16, 207.18, 207.24
See application file for complete search history.

(56) References Cited

U.S. PATENT DOCUMENTS 4,520,420 A * 5/1985 Ariyoshi et al. ..... 361/154

(Continued)

FOREIGN PATENT DOCUMENTS

DE 102005038934 2/2007

(Continued)

OTHER PUBLICATIONS

International Search Report, PCT International Application No. PCT/EP2010/068715, dated Apr. 8, 2011.

*Primary Examiner* — Mahmoud Gimie
(74) *Attorney, Agent, or Firm* — Kenyon & Kenyon LLP

(57) ABSTRACT

A method for operating a valve, in particular a fuel injector of an internal combustion engine of a motor vehicle, in which an auxiliary variable is obtained as a function of at least one electrical operating variable of an electromagnetic actuator driving a component of the valve, in particular a valve needle, and in which the auxiliary variable is checked for the presence of a predefinable characteristic. A reference variable which characterizes the operating behavior of the electromagnetic actuator is ascertained, the auxiliary variable is modified as a function of the reference variable to obtain a modified auxiliary variable, and the modified auxiliary variable is checked for the presence of the predefinable characteristic.

18 Claims, 4 Drawing Sheets

(51) Int. Cl.

| | |
|---|---|
| ***F02D 41/24*** | (2006.01) |
| ***H01F 7/18*** | (2006.01) |
| *F02M 51/06* | (2006.01) |
| *F02D 41/14* | (2006.01) |

(52) U.S. Cl.

CPC ..... *H01F 7/1844* (2013.01); *F02D 2041/1433* (2013.01); *F02D 2041/2037* (2013.01); *F02D 2041/2055* (2013.01)

USPC ..... 123/490; 123/478

(56) References Cited

U.S. PATENT DOCUMENTS

| | | | | |
|---|---|---|---|---|
| 4,604,675 | A * | 8/1986 | Pflederer | 361/155 |
| 5,267,545 | A * | 12/1993 | Kitson | 123/490 |
| 6,031,707 | A * | 2/2000 | Meyer | 361/153 |
| 6,949,923 | B2 | 9/2005 | Schultz et al. | |
| 2007/0041131 | A1 | 2/2007 | Kesselgruber et al. | |

FOREIGN PATENT DOCUMENTS

| | | |
|---|---|---|
| DE | 102008055008 | 6/2010 |
| DE | 102009032521 | 1/2011 |
| EP | 0 438 640 | 7/1991 |
| EP | 1302952 | 4/2003 |
| WO | WO 2004102600 | 11/2004 |

* cited by examiner

METHOD AND CONTROL UNIT FOR OPERATING A VALVE

FIELD OF THE INVENTION

The present invention relates to a method for operating a valve, in particular a fuel injector of an internal combustion engine of a motor vehicle, in which an auxiliary variable is obtained as a function of at least one electrical operating variable of an electromagnetic actuator driving a component of the valve, in particular a valve needle, and in which the auxiliary variable is checked for the presence of a predefinable characteristic. The present invention also relates to a control unit for operating a valve of this type.

BACKGROUND INFORMATION

Methods and devices of the aforementioned type are usually used to obtain information about an operating state of the valve. Particularly important changes in the operating state, for example a transition from an open state to a closed state, are derivable from extremes of a time characteristic of the auxiliary variable, at least in some operating modes or operating points of conventional injectors.

However, the evaluation accuracy of conventional methods is often insufficient, in particular in the event of short activation times and/or minimal valve lifts.

SUMMARY

An object of the present invention is to improve a method and a control unit of the type mentioned above in such a way that a more precise evaluation and the obtaining of information on an operating state are possible even in the event of minimal valve lifts.

In accordance with the present invention, this object may be achieved using an example method that ascertains a reference variable which characterizes the operating behavior of the electromagnetic actuator, modifies the auxiliary variable as a function of the reference variable to obtain a modified auxiliary variable, and checks the modified auxiliary variable for the presence of the predefinable characteristic.

Preparing the auxiliary variable in this way according to the present invention allows for a particularly precise evaluation, thus providing high evaluation accuracy with regard to detecting changes in the operating state of the valve, in particular in the event of short activation times or minimal valve lifts.

According to one variant of the present invention, a time characteristic of an actuator voltage or an actuator current is particularly advantageously used as the at least one electrical operating variable for forming the auxiliary variable, i.e., a time characteristic of an electrical voltage applied to a solenoid coil of an electromagnetic actuator or a time characteristic of the current flowing through the solenoid coil.

According to the present invention, it has been found that a first signal portion of the auxiliary variable, which is generated on the basis of the magnetic and electrical properties of the magnetic circuit of the electromagnetic actuator, and a second signal portion which is generated by a movement of elements of the magnetic circuit and thus by the change in geometric parameters of the magnetic circuit, are always present regardless of the specific formation of the auxiliary variable (e.g., via the actuator voltage and/or the actuator current).

In operating areas of this type, in which the solenoid armature, as the moving component of the magnetic circuit, moves only a relatively short distance (actual lift much smaller than maximum nominal lift) or quickly, the portion of the signal of the auxiliary variable generated by the armature movement decreases, while the first signal portion of the auxiliary variable, which is generated on the basis of the magnetic and electrical properties of the magnetic circuit of the electromagnetic actuator, remains generally the same.

This makes it more difficult to detect a predefinable characteristic in the auxiliary variable using conventional methods.

Using the reference variable according to the present invention, which preferably simulates the first signal portion of the auxiliary variable, this portion being generated on the basis of the magnetic and electrical properties of the magnetic circuit of the electromagnetic actuator, the particularly interesting second signal portion, which is generated by a movement of elements of the magnetic circuit and thus by a change in geometric parameters of the magnetic circuit, may thus be advantageously selectively evaluated.

According to another advantageous variant of the present invention, a particularly efficient evaluation results if the reference variable is obtained with the aid of a model which simulates a dynamic behavior of the electromagnetic actuator, in particular its magnetic circuit.

According to another variant of the present invention, it may be particularly advantageously provided that the model simulates a time characteristic of the at least one electrical operating variable and/or the auxiliary variable, in particular the provision thereof without a movement of a movable component (e.g., a solenoid armature) of the electromagnetic actuator.

Alternatively or additionally, the reference variable may be obtained as a function of the at least one electrical operating variable, in particular preferably from values of the at least one electrical operating variable obtained in an operating mode of the electromagnetic actuator in which there is no movement of a movable component (e.g., solenoid armature) of the electromagnetic actuator. For this purpose, the values of the at least one electrical operating variable are preferably detected by measurement during a particular activation of the electromagnetic actuator. The particular activation, characterized for example by a relatively short activation time, advantageously ensures that an armature movement does not already occur despite the activation.

Another very advantageous variant of the present invention provides that the modified auxiliary variable is obtained in that the reference variable is subtracted from the auxiliary variable, which imposes particularly minimal requirements on a control unit which carries out the example method according to the present invention or on a processor included therein.

According to another advantageous variant of the present invention, it is furthermore possible to divide a difference between the auxiliary variable and the reference variable by the auxiliary variable and/or the reference variable to obtain the modified auxiliary variable.

According to another very advantageous variant of the present invention, the reference variable according to the present invention may be stored after it is ascertained, so that it is available for carrying out the example method according to the present invention in the future and does not have to be constantly re-ascertained.

It may be of particular interest to implement the operating method according to the present invention in the form of a computer program which may be stored on an electronic and/or optical storage medium and which is executable by a control and/or regulating system, e.g., for an internal combustion engine.

Additional advantages, features and details arise from the description below, in which different exemplary embodiments of the present invention are illustrated with reference to the figures. The features mentioned in the description may each be used for the present invention either individually or in any combination.

DETAILED DESCRIPTION OF EXAMPLE EMBODIMENTS

Figure 1:
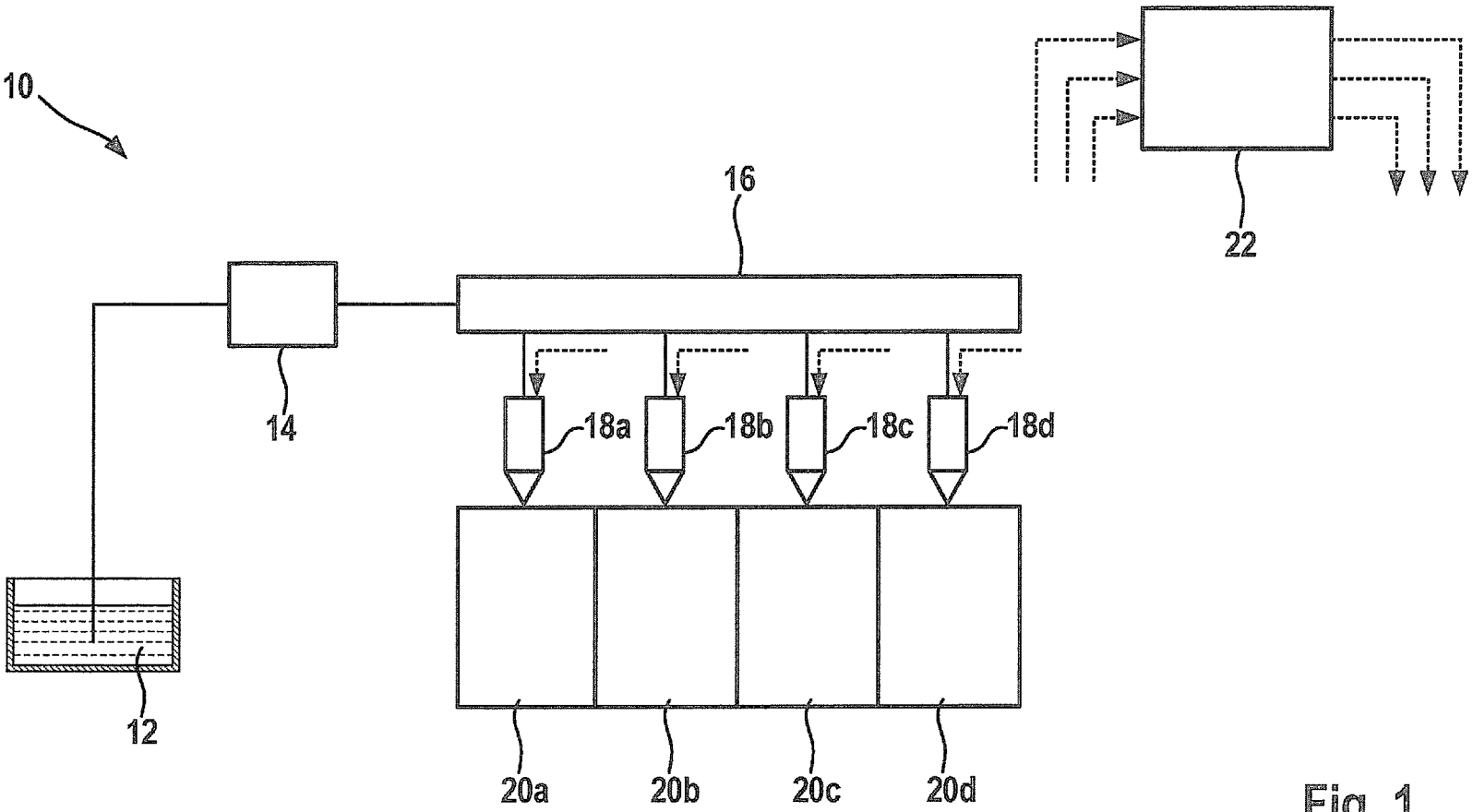
FIG. 1 shows a schematic representation of an internal combustion engine having multiple injectors operated in accordance with the present invention.

In FIG. 1, an internal combustion engine is identified as a whole by reference numeral 10. It includes a tank 12 from which a delivery system 14 delivers fuel to a common rail 16. Multiple electromagnetically actuated injectors 18*a* through 18*d*, which inject the fuel directly into combustion chambers 20*a* through 20*d* assigned to them, are connected thereto. The operation of internal combustion engine 10 is controlled or regulated by a control and regulating system 22, which activates injectors 18*a* through 18*d*, among other things.

Figure 2C:
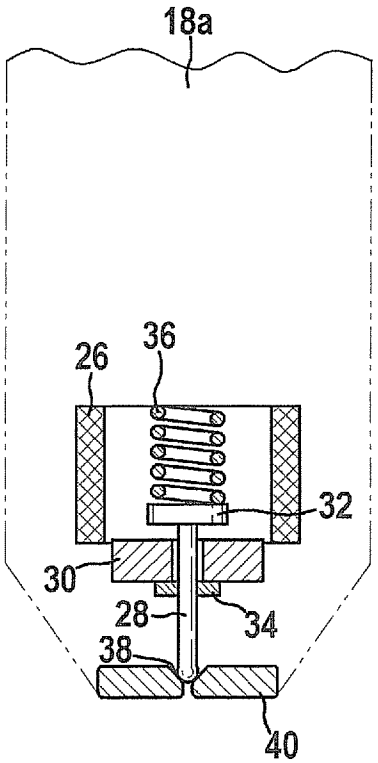
FIGS. 2*a* through 2*c* show schematic representations of a detailed view of an injector from FIG. 1 in three different operating states.
Figure 2B:
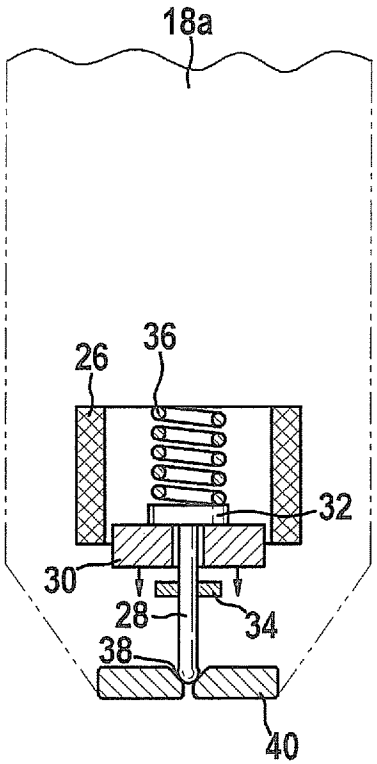
Figure 2A:
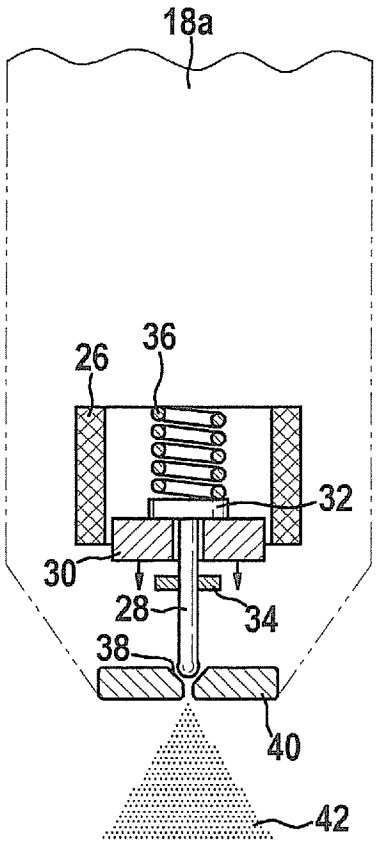

FIGS. 2*a* through 2*c* show schematic representations of injector 18*a* according to FIG. 1 in a total of three different operating states. The other injectors 18*b*, 18*c*, 18*d*, which are also illustrated in FIG. 1, have a corresponding structure and functionality.

Injector 18*a* has an electromagnetic actuator which includes a solenoid coil 26 and a solenoid armature 30 which cooperates with solenoid coil 26. Solenoid armature 30 is connected to a valve needle 28 of injector 18*a* in such a way that it is movable relative to valve needle 28 in a non-vanishing mechanical clearance in relation to a vertical direction of movement of valve needle 28 in FIG. 2*a*.

This results in a two-part mass system 28, 30, which drives valve needle 28 with the aid of electromagnetic actuator 26, 30. This two-part configuration improves the mountability of injector 18*a* and reduces undesirable rebounding of valve needle 28 when it strikes its valve seat 38.

In the present configuration illustrated in FIG. 2*a*, the axial clearance of solenoid armature 30 on valve needle 28 is limited by two stops 32 and 34. However, at least lower stop 34 in FIG. 2*a* could be implemented in the form of an area of the housing of injector 18*a*.

As shown in FIG. 2*a*, a corresponding elastic force against valve seat 38 is applied to valve needle 28 in the area of housing 40 by a valve spring 36. In FIG. 2*a*, injector 18*a* is shown in its open state. In this open state, solenoid armature 30 is moved upward by an energization of solenoid coil 26 in FIG. 2*a*, so that it moves valve needle 28 out of its valve seat 38 against the elastic force by engaging with stop 32. This enables fuel 42 to be injected into combustion chamber 20*a* (FIG. 1) by injector 18*a*.

As soon as the energization of solenoid coil 26 by control unit 22 (FIG. 1) is ended, valve needle 28 moves toward its valve seat 38 under the effect of the elastic force applied by valve spring 36 and carries solenoid armature 30 along with it. A transmission of force from valve needle 28 to solenoid armature 30 again takes place with the aid of upper stop 32.

As soon as valve needle 28 ends its closing movement by striking valve seat 38, solenoid armature 30 may continue to move downward, as shown in FIG. 2*b*, due to the axial clearance in FIG. 2*b*, until it rests against second stop 34, as illustrated in FIG. 2*c*.

Figure 3:
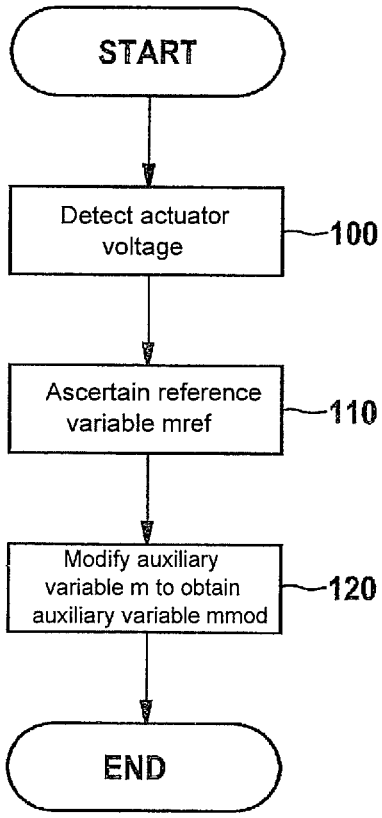
FIG. 3 shows a simplified flow chart of a specific embodiment of the method according to the present invention.

According to the present invention, the method described below with reference to the flow chart according to FIG. 3 is carried out to obtain particularly precise information about an operating state or a change in the operating state of injector 18*a*.

In a first step 100 of the method according to the present invention, an electrical operating variable of electromagnetic actuator 26, 30 (FIG. 2*a*), for example the actuator voltage in the present case, which is applied to solenoid coil 26 of the actuator, is detected. This may take place with the aid of a measuring instrument integrated into control unit 22 (FIG. 1) in a conventional manner. An auxiliary variable m (FIG. 5) is then formed as a function of actuator voltage u, also in step 100.

In the simplest case, auxiliary variable m may be identical to the actuator voltage. However, auxiliary variable m may also be generally obtained as a function of the actuator voltage and/or the actuator current flowing through solenoid coil 26. A filtering as well as other common signal processing methods may also be used to obtain auxiliary variable m from the actuator voltage and/or the actuator current.

A reference variable mref (FIG. 5), which characterizes the operating behavior of electromagnetic actuator 26, 30, is ascertained in a subsequent step 110.

According to a preferred specific embodiment of the present invention, reference variable mref is obtained with the aid of a model 200 (FIG. 6) which simulates a dynamic behavior of electromagnetic actuator 26, 30, in particular its magnetic circuit. For this purpose, it may be particularly advantageously provided that model 200 simulates a time characteristic of the at least one electric operating variable (actuator voltage, actuator current) and/or auxiliary variable m, which is obtained, in particular, without a movement of a movable component—solenoid armature 30 in the present case—of the electromagnetic actuator.

Figure 5:
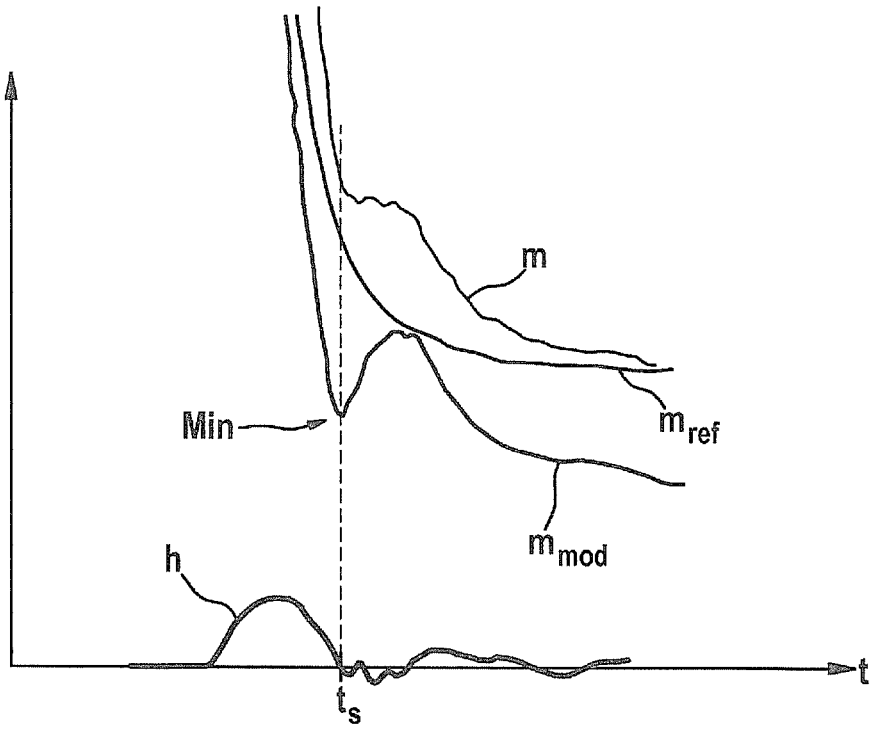
FIG. 5 shows a time characteristic of an auxiliary variable obtained from an electrical operating variable of the valve from FIG. 2*a* as well as variables derived therefrom in accordance with the present invention.

In step 120 of the method according to the present invention, auxiliary variable m is subsequently modified as a function of reference variable mref to obtain a modified auxiliary variable mmod (FIG. 5).

According to studies by the applicant, auxiliary variable mmod, which is modified in the manner described above, has a particularly strong correlation with important changes in the operating state of valve 18*a* and is therefore ideally suited to detecting such changes in the operating state.

In particular, it is possible, by forming the modified auxiliary variable, to extremely precisely ascertain a hydraulic closing point in time of valve 18*a* at which valve needle 28 reaches its closed position in the area of the injection holes or of valve seat 38.

Figure 4:
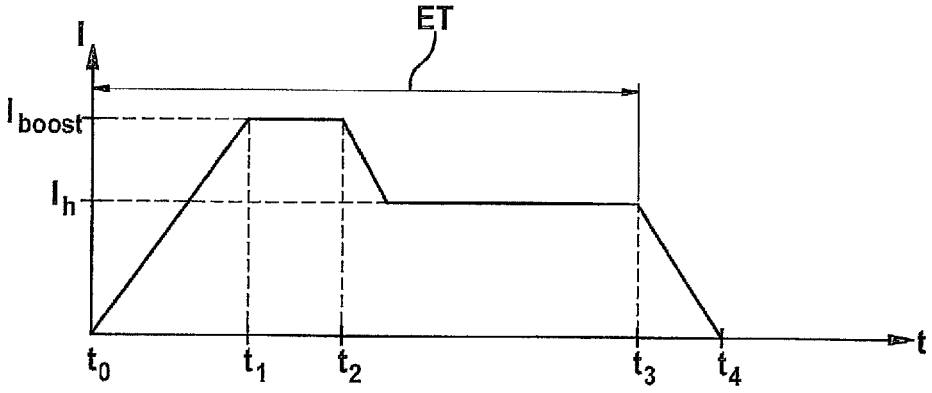
FIG. 4 shows a schematic representation of a time characteristic of an activating current for a valve operated in accordance with the present invention.

FIG. 4 shows a schematic representation of an exemplary time characteristic of an activating current I for electromagnetic actuator 26, 30 (FIG. 2*a*) of valve 18*a* during an activation for a fuel injection.

To enable valve 18*a* to open rapidly from its closed state at t=t0, activating current I is increased from point in t0, which corresponds to the activation start, from value I=0 to booster current Iboost. Booster current Iboost is reached at point in time t1. The booster current is maintained until subsequent point in time t2.

It may be assumed that valve 18*a* has reached its open state at end t2 of the so-called booster phase, which lies between point in time t0 and point in time t2. To continue to keep the valve open at points in time t≥t2, activating current I is now reduced not to zero but to so-called holding current Ih.

According to FIG. 4, holding current Ih is maintained until point in time t3. Time difference t3−t0 defines total electrical activating time ET of valve 18*a* or its electromagnetic actuator 26, 30.

At the end of activating time ET, i.e., starting at t=t3, control unit 22 no longer applies an activating current or a corresponding activating voltage to electromagnetic actuator 26, 30, so that the activating current still present finally decreases to zero by point in time t4, according to the laws of induction.

FIG. 5 shows a time characteristic of needle lift h of valve needle 28 (FIG. 2*a*), which results during an activation according to activating current characteristic I described above (cf. FIG. 4) at very short electrical activation times ET.

In activation operations of this type, in which a relatively short activation time ET or a relatively small maximum valve lift h is present, auxiliary variable m usually does not have any characteristics which may be very easily and directly evaluated to reliably determine actual hydraulic closing point in time ts (FIG. 5). At actual closing point in time ts, auxiliary variable m examined according to the present invention has a non-vanishing curvature in the present case, but not a local extreme which is easily detectable, for example.

The representation of the variables shown in FIG. 5 is not true to scale. In particular, auxiliary variable m may indeed have a far less significant characteristic at point in time ts than is shown in the present illustration in FIG. 5.

Using the principle according to the present invention, a reference variable mref is therefore formed to permit an efficient evaluation of auxiliary variable m.

A modification of auxiliary variable m according to the present invention with the aid of reference variable mref results in modified auxiliary variable mmod, which has a pronounced local minimum Min at closing point in time ts, as shown in FIG. 5.

Accordingly, the formation of reference variable mref according to the present invention and the subsequent modification of auxiliary variable m as a function of reference variable mref, whereby a modified auxiliary variably mmod is obtained, advantageously permit a simple evaluation of auxiliary variable m or modified auxiliary variable mmod for the presence of a change in the operating state, such as the closing operation of valve 18*a* described above.

The principle according to the present invention has proven to be particularly reliable, in particular at relatively short activation times ET as well as relatively small maximum needle lifts h.

The variables described above—auxiliary variable m, reference variable mref, modified auxiliary variable mmod—are preferably a corresponding time characteristic of the relevant variables. In one embodiment of the operating method according to the present invention, a sufficiently high sampling rate for the respective variables m, mref, mmod must be selected according to the desired precision, with the aid of digital signal processing.

A formation of modified auxiliary variable mmod which requires particularly little computing complexity, is achieved in that reference variable mref is subtracted from auxiliary variable m.

According to the present invention, it may furthermore be provided that a difference is obtained from variables m, mref, which, in turn, is divided by auxiliary variable m and/or reference variable mref to obtain modified auxiliary variable mmod, for example:

$$m\text{mod}=(m-m\text{ref})/m.$$

Figure 6:
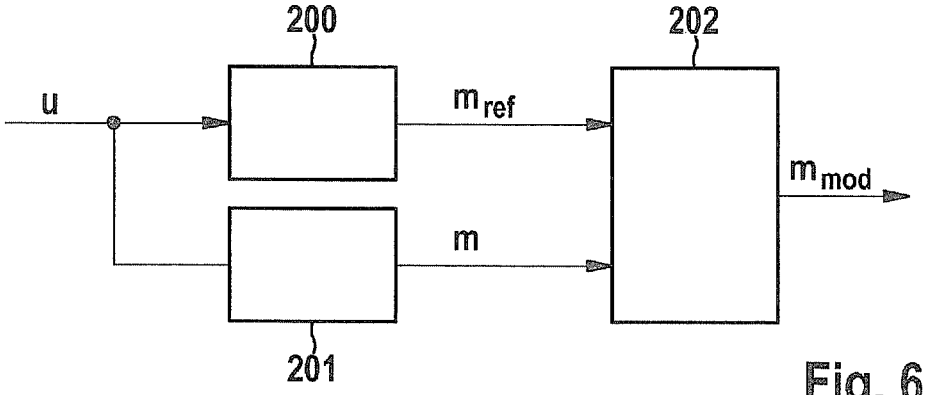
FIG. 6 shows a function diagram for implementing a variant of the method according to the present invention.

FIG. 6 shows a block diagram of an arithmetic structure by way of example for ascertaining modified auxiliary variable mmod according to the present invention. Reference variable mref is formed from actuator voltage u with the aid of model 200 according to the present invention.

Auxiliary variable m is obtained with the aid of function block 201—also as a function of actuator voltage u in the present case.

In the simplest case, auxiliary variable m may be identical to actuator voltage u, as described previously. In this case, function block 201 may be dispensed with. However, auxiliary variable m may also be generally obtained as a function of actuator voltage u and/or actuator current I flowing through solenoid coil 26. A filtering as well as other common signal processing methods may also be used to obtain auxiliary variable m from the actuator voltage and/or the actuator current.

Reference variable mref and auxiliary variable m itself are then supplied to subtracter 202, which ascertains difference m−mref therefrom. Due to the properties of reference variable mref according to the present invention, difference m−mref obtained at the output of function block 202 essentially reflects a signal portion of auxiliary variable m which is obtained on the basis of the armature movement of solenoid armature 30 (FIG. 2*a*).

In a preferred specific embodiment of the present invention, this difference may therefore be used directly as a modified auxiliary variable mmod to be checked for an interesting characteristic, e.g., a local minimum Min (FIG. 5).

In another preferred specific embodiment of the present invention, instead of model 200 (FIG. 6), reference variable mref is obtained directly as a function of at least one electrical operating variable, e.g., actuator voltage u or actuator current I, from such values of this/these variable(s) u, I which result in an operating mode of electromagnetic actuator 26, 30 in which there is no movement of the movable component, i.e., solenoid armature 30 of electromagnetic actuator 26, 30 in the present case.

For this purpose, electromagnetic actuator 26, 30 may be selectively activated, for example, in such a way that an actuator movement does not already result. This is achieved, for example, by a sufficiently short activation time ET. During the activation, the values of the at least one electrical operating variable u, I are detected by measurement to be used henceforth as reference variable mref in the sense of the method according to the present invention.

Reference variable mref ascertained according to the present invention may also be particularly advantageously stored after its ascertainment 110 (FIG. 3) for a future use so that it does not have to be constantly re-ascertained.

Although the method according to the present invention is preferably used to detect characteristics Min which are not ascertainable using conventional methods, other more easily detectable changes in operating states may also generally be ascertained using the method according to the present invention, which results in a standard evaluation and correspondingly little complexity.

It is also possible to use the method according to the present invention alternately with other detection methods for detecting other characteristics of auxiliary variable m.

The principle according to the present invention may be used regardless of whether auxiliary variable m, which has interesting characteristic Min, is obtained with the aid of analog or digital signal processing or by carrying out conventional signal processing or preparation processes, such as filtering, differentiation or integration. In such cases, it is only necessary to ensure that model 200 simulates processing steps which correspond to the signal processing processes used, so that reference variable mref obtained on the basis of the model matches auxiliary variable m to be evaluated.

The same applies to variants of the present invention in which reference variable mref is ascertained from variables u, I obtained by measurement instead of a model-based ascertainment of reference variable mref.

In the variants of the present invention in which reference variable mref is ascertained from variables u, I obtained by measurement, it may be furthermore particularly important for the actuator or valve 18*a* to have a securely closed state during activation of actuator 26, 30 for ascertaining corresponding measured values of variables u, I to form reference variable mref, so as to avoid obtaining signal portions generated by the armature movement as components of reference variable mref.

What is claimed is:

1. A method for operating a valve, comprising:

obtaining an auxiliary variable as a function of at least one electrical operating variable of an electromagnetic actuator driving a valve needle of the valve;

ascertaining a reference variable which characterizes an operating behavior of the electromagnetic actuator;

modifying the auxiliary variable as a function of the reference variable to obtain a modified auxiliary variable;

checking the modified auxiliary variable for presence of a predefinable characteristic; and detecting a change in the operating state of the valve when the check indicates the presence of the predefinable characteristic.

2. The method as recited in claim 1, wherein the valve is a fuel injector of an internal combustion engine.

3. The method as recited in claim 1, wherein a time characteristic of one of an actuator voltage or an actuator current is used as at least one electrical operating variable for forming the auxiliary variable.

4. The method as recited in claim 1, wherein the reference variable is obtained with the aid of a model which simulates a dynamic behavior of the electromagnetic actuator.

5. The method as recited in claim 4, wherein the model simulates a dynamic behavior of a magnetic circuit of the electromagnetic actuator.

6. The method as recited in claim 4, wherein the model simulates a time characteristic of at least one of: i) the at least one electrical operating variable, and ii) the auxiliary variable which results without a movement of a movable component of the electromagnetic actuator.

7. The method as recited in claim 1, wherein the reference variable is obtained as a function of the at least one electrical operating variable.

8. The method as recited in claim 7, wherein the reference variable is obtained from values of the at least one electrical operating variable, which result in an operating mode of the electromagnetic actuator in which there is no movement of a movable component of the electromagnetic actuator.

9. The method as recited in claim 8, wherein the values of the at least one electrical operating variable are detected by measurement during an activation of the electromagnetic actuator.

10. The method as recited in claim 1, wherein the modified auxiliary variable is obtained in that the reference variable is subtracted from the auxiliary variable.

11. The method as recited in claim 10, wherein a difference between the auxiliary variable and the reference variable is divided by at least one of the auxiliary variable and the reference variable, to obtain the modified auxiliary variable.

12. The method as recited in claim 1, wherein the reference variable is stored after it is ascertained.

13. The method as recited in claim 12, wherein the stored reference variable is used to modify the auxiliary variable.

14. The method as recited in claim 1, wherein the auxiliary variable is identical to one of the at least one electrical operating variable.

15. The method as recited in claim 1, wherein the predefinable characteristic is one of a local minimum.

16. A storage medium storing a computer program for operating a valve, the computer program, when executed by a processor, causing the processor to perform the steps of:

obtaining an auxiliary variable as a function of at least one electrical operating variable of an electromagnetic actuator driving a valve needle of a valve;

ascertaining a reference variable which characterizes an operating behavior of the electromagnetic actuator;

modifying the auxiliary variable as a function of the reference variable to obtain a modified auxiliary variable;

checking the modified auxiliary variable for presence of a predefinable characteristic; and detecting a change in the operating state of the valve when the check indicates the presence of the predefinable characteristic.

17. The storage medium as recited in claim 16, wherein the storage medium is one of an electronic storage medium and an optical storage medium.

18. A control or regulating system for operating a valve system, the system configured to obtain an auxiliary variable as a function of at least one electrical operating variable of an electromagnetic actuator driving a valve needle of a valve, ascertain a reference variable which characterizes an operating behavior of the electromagnetic actuator, modify the auxiliary variable as a function of the reference variable to obtain a modified auxiliary variable, check the modified auxiliary variable for presence of a predefinable characteristic, and detect a change in the operating state of the valve when the check indicates the presence of the predefinable characteristic.

* * * * *